US009809997B2

(12) United States Patent
Ayrest

(10) Patent No.: US 9,809,997 B2
(45) Date of Patent: Nov. 7, 2017

(54) CAMLOCK

(71) Applicant: Robert B. Ayrest, Placerville, CA (US)

(72) Inventor: Robert B. Ayrest, Placerville, CA (US)

( * ) Notice: Subject to any disclaimer, the term of this patent is extended or adjusted under 35 U.S.C. 154(b) by 0 days.

(21) Appl. No.: 14/706,306

(22) Filed: May 7, 2015

(65) Prior Publication Data

US 2015/0240520 A1 Aug. 27, 2015

Related U.S. Application Data

(63) Continuation-in-part of application No. 13/889,215, filed on May 7, 2013, now abandoned.

(51) Int. Cl.

| | |
|---|---|
| ***E05B 15/00*** | (2006.01) |
| ***E05B 17/20*** | (2006.01) |
| ***E05B 65/44*** | (2006.01) |
| ***E05C 3/04*** | (2006.01) |
| ***E05B 15/16*** | (2006.01) |

(Continued)

(52) U.S. Cl.

CPC ..... *E05B 15/00* (2013.01); *E05B 15/1607* (2013.01); *E05B 17/2019* (2013.01); *E05B 19/0047* (2013.01); *E05B 65/44* (2013.01); *E05C 3/042* (2013.01); *E05B 2015/0468* (2013.01); *E05B 2015/1642* (2013.01); *Y10T 70/7486* (2015.04)

(58) Field of Classification Search

CPC .. E05B 15/00; E05B 17/2019; E05B 19/0047; E05B 65/44; E05B 2015/0468; E05B 2015/1642; E05B 2015/0403; E05B 2015/0406; E05B 2015/0413; E05B 2015/042; E05B 2015/0431; E05B 2015/0458; E05B 2015/0462; E05B 2015/0465; E05B 2015/0472; E05B 2015/0496; E05B 57/00; E05B 63/22; E05B 15/143; E05B 17/044; E05B 17/045; E05B 17/04; E05B 29/00; E05B 29/0013; E05B 21/06; E05B 21/063; E05B 21/066; Y10T 292/0947; Y10T 292/0949; Y10T 292/1077; Y10T 292/108; E05C 3/06; E05C 3/10

USPC ..... 70/403, 375, 491, 496, 453, 454, 379 A, 70/379 R, 404

See application file for complete search history.

(56) References Cited

U.S. PATENT DOCUMENTS 1,458,520 A * 6/1923 Castell ..... E05B 27/08 70/356

1,994,095 A * 3/1935 Caldwell ..... E05B 15/06 70/120

(Continued)

*Primary Examiner* — Christopher J Boswell
*Assistant Examiner* — Amanda L Bailey
(74) *Attorney, Agent, or Firm* — Howard Cohen

(57) ABSTRACT

An all-plastic, tumbler-free cam lock includes a cylindrical lock body with a flange extending radially from the distal end to be glued to a surface surrounding a mounting hole. The lock body has a bore extending axially and a central spindle received coaxially in the bore. A key has a cylindrical tubular key body insertable concentrically between the lock body shoulder and the distal end of the spindle. A pair of outer key lugs extend radially outwardly from the tubular key body to pass through the key channels of an interior shoulder of the lock body, thus permitting access only by one key configuration. A third key lug extends radially inwardly from the inner surface of the tubular key body to engage a keyway channel of the spindle.

21 Claims, 5 Drawing Sheets

(51) Int. Cl.
*E05B 19/00* (2006.01)
*E05B 15/04* (2006.01)

(56) References Cited

U.S. PATENT DOCUMENTS

| | | | | | |
|---|---|---|---|---|---|
| 2,055,289 | A * | 9/1936 | Hanan | E05B 83/247 | 292/DIG. 14 |
| 3,661,001 | A * | 5/1972 | Glass | E05B 63/003 | 70/388 |
| 3,699,790 | A * | 10/1972 | Ansala | E05B 21/063 | 70/140 |
| 4,022,039 | A * | 5/1977 | Mikos | E05B 63/003 | 70/388 |
| 4,193,276 | A * | 3/1980 | Lundberg | E05B 67/365 | 70/34 |
| 4,289,001 | A * | 9/1981 | Corfield | E05B 35/00 | 70/346 |
| 4,878,367 | A * | 11/1989 | Bisbing | E05B 35/008 | 70/404 |
| 5,737,950 | A * | 4/1998 | Yun-Bin | E05B 17/04 | 70/374 |
| 6,018,969 | A * | 2/2000 | Haseley | E05B 35/008 | 292/DIG. 60 |
| 7,716,958 | B2 * | 5/2010 | Martin | E05B 9/04 | 70/367 |
| 9,216,747 | B2 * | 12/2015 | Matoba | B61D 17/00 | |
| 2002/0167180 | A1 * | 11/2002 | Sucu | E05B 65/0841 | 292/202 |
| 2009/0303831 | A1 * | 12/2009 | Allen | B05B 7/2424 | 366/130 |

* cited by examiner

CAMLOCK

CROSS-REFERENCE TO RELATED APPLICATIONS

This application is a continuation-in-part of application Ser. No. 13/889,215, filed May 7, 2013, and the benefit of the priority filing date is claimed for all common subject matter.

FEDERALLY SPONSORED RESEARCH

Not applicable.

SEQUENCE LISTING, ETC ON CD

Not applicable.

BACKGROUND OF THE INVENTION

Field of the Invention

This invention relates to locks for securing doors and cabinet openings and, more particularly, to cam locks that are used in combination with plastic or polymer doors and cabinets.

Description of Related Art

Cam locks are recognized in the prior art as devices that secure doors, drawers, cabinet tops, and the like from unauthorized opening. In general, a cam lock includes a lock body having an internal spindle that is rotatable, and a cam (latch arm) that extends radially from the inner end of the spindle to engage a strike or a fixed structural component. A key is insertable into the lock body to rotate the spindle from a closed position in which the cam engages the strike or structural component, to an open position in which the cam is free of any engagement.

Cam locks are often used in low security situations in which the intent is to prevent casual opening of a cabinet door or drawer or the like. In these situations the lock body may incorporate a simple mechanism that accepts only a certain type or shape of key, but it does not use extensive tumbler locking arrangements.

A typical cam lock in the prior art extends through a hole in the item (door, drawer, panel) being secured. The hole is often standardized as a "Double D" hole, a partially circular hole having opposed parallel flats, and the hole is placed adjacent to a structural frame component or latch strike. The cam lock body is likewise provided with a primarily cylindrical shape with the inclusion of parallel flats that are complementary to the hole shape. The exterior end of the lock body includes a radial flange that impinges on the outer surface of the item being secured, and the lock body is typically secured by a nut secured on threads at the interior end of the lock body, or occasionally a spring clip. The flat surfaces of the lock body engage the parallel flats of the double D hole so the lock cannot turn in the hole, and the nut may be well-tightened to secure the lock.

The components enumerated above are typically fabricated of metals such as steel, brass, and the like, and are compatible with the items being secured, which are likewise fabricated of metal. However, in recent times cabinets, doors, drawers, tops, and similar items to be secured more often have been fabricated of plastic or polymer materials. It has been observed that the metal components of a typical cam lock are not necessarily compatible with plastic or polymer items to be secured, or vice versa. For example, if a metal cam lock is secured to a plastic closure by a nut or a spring clip, the compression of the nut or clip combined with the thermal expansion/contraction of the plastic may degrade the plastic components over time, due to the metal being substantially harder and less thermally active than the plastic material. As a result, degradation of the plastic components increases with continued use, causing failure of the plastic. Also, the double D hole is difficult to form in plastic, so a simpler choice is to drill out a round hole that does not grab the flat sides of the lock, which then tends to turn in the hole. This tendency to rotation of the lock causes the installer to tighten the nut even more.

BRIEF SUMMARY OF THE INVENTION

The present invention generally comprises a cam lock that has an improved design that may be executed entirely in plastic or polymer and is complementary in particular to non-metallic doors and cabinets.

The lock includes a generally cylindrical lock body dimensioned to fit through a lock mounting hole and having a flange extending radially from the distal end thereof. The flange has a proximal-facing flat annular surface that impinges on the outer surface of the door and is arranged to be glued or solvent bonded to the door surface adjacent to the mounting hole. (Note that in this description the lock likewise may be mounted on a fixed frame component adjacent to a door or moving closure.) The lock body has a bore extending axially therein, and an interior shoulder disposed at the distal end of the bore extends radially inwardly to define a reduced diameter distal opening. The shoulder of the bore includes two channels extending therethrough parallel to the axis and spaced apart 90° about the axis.

The lock further includes a central spindle extending axially in the bore in rotatable fashion in a close tolerance fit. The distal end of the spindle has a neck that is dimensioned to be received in the distal end of the lock body bore, and the proximal end of the spindle has a wider diameter that is complementary to the proximal bore section of the lock body. An annular shoulder extends between the proximal and distal portions of the spindle, the annular shoulder having a stepped annular surface that extends slightly less than one-half of the annular surface. The distal end of the spindle is provided with a keyway channel extending therein parallel to the axis of the assembly.

In addition, a slot extends in chordal fashion in the wider proximal end of the spindle, the slot being parallel to the step of the annular shoulder at the juncture of the proximal and distal portions of the spindle. A pin channel is also formed in the wider proximal end of the spindle, extending annularly and describing an angle of approximately 90° about the axis of the spindle. A locking pin is pressed through a hole in the lock body into the pin channel to retain the spindle within the lock body and to limit the spindle rotation to the solid angle of the pin channel. A neck portion at the proximal end of the spindle extends axially and proximally out of the proximal end of the bore of the lock body. An annular end plate is joined to the proximal end of the neck.

A lock cam comprises a generally rectangular plate having a cam slot extending into one end thereof and configured to snap-engage the neck portion of the spindle in a fixed attachment. A cam pin extends from the cam adjacent to the cam slot and is configured to engage a cam cutout formed in the perimeter of the annular end plate that is joined to the spindle.

Another component is a semi-helix split washer locking device that extends about the distal end portion of the spindle within the lock body and abutting the proximal portion of the spindle. The lock washer is formed entirely of plastic, and has a ramped configuration that describes one-half cycle of a helix, with a radial step formed at the confronting free ends of the helical shape. The radial step engages the step of the annular surface of the proximal portion of the spindle to aid in rotating the spindle in the latching direction, as explained below. The lock washer also includes a lug extending therefrom radially inwardly and configured to be engaged in the channel extending longitudinally in the distal end of the spindle. The lock washer is seated at the distal annular surface of the proximal portion of the spindle. The lock washer may be provided with three radially extending tabs projecting proximally therefrom and disposed to engage complementary slots formed in the annular shoulder of the spindle to assure rotational movement in common between the lock washer and spindle.

A key for the lock assembly includes a generally cylindrical tubular key body having a key tab extending distally therefrom. The tubular key body is configured to be inserted into the distal end of the lock body and to extend concentrically between the lock body bore and the distal end of the spindle. A pair of outer key lugs extend radially outwardly from the tubular key body and are angularly spaced 90° about the axis of the tubular key body. In addition, a third key lug extends radially inwardly from the inner surface of the tubular key body and is aligned with one of the pair of outer key lugs.

In the locked disposition the spindle is angularly oriented so that the channel at the distal end of the spindle is aligned with one of the channels in the interior shoulder at the distal end of the bore of the lock body. This enables the key to be inserted concentrically between the spindle and bore of the lock body, with one of the pair of outer key lugs and the aligned third key lug slidably engaging the two channels in the distal bore portion of the lock body and the channel in the distal spindle portion, and the other outer key lug slidably engaging the other channel in the distal bore portion of the lock body.

When the key is inserted fully into the lock, the pair of outer key lugs extend proximally beyond the channels in the lock body bore. The proximal end of the key impinges on the semi-helix split washer locking device and deforms it resiliently in the axial direction, enabling the key to turn in the lock. The key remains rotationally engaged with the spindle by the third key lug remaining within the channel in the distal end of the spindle, and the lock washer lugs engaging the complementary slots in the spindle shoulder. Thus the key may be turned (i.e., counterclockwise) in the lock to rotate the spindle and lock washer, causing the lock cam to rotate 90° (as allowed by the locking pin travel in the pin channel) and move free of engagement with a frame member or latch strike. When the key is rotated clockwise the rotation of the spindle is reversed, and the cam plate cutout engages the cam pin to aide in driving the lock cam to counter-rotate and engage the frame component or latch strike, thus relocking the door.

The components may be molded of acrylic, polycarbonate, or other plastics to be long-lasting. Aside from the lock being compatible with plastic and polymer doors and the like, it should be noted that the component count is reduced to a minimum: only five assembled parts comprise the entire lock, plus one key to operate it. This factor alone results in a great amount of savings in manufacturing, resulting in a low price point for the assembly.

DETAILED DESCRIPTION OF THE INVENTION

Figure 12:
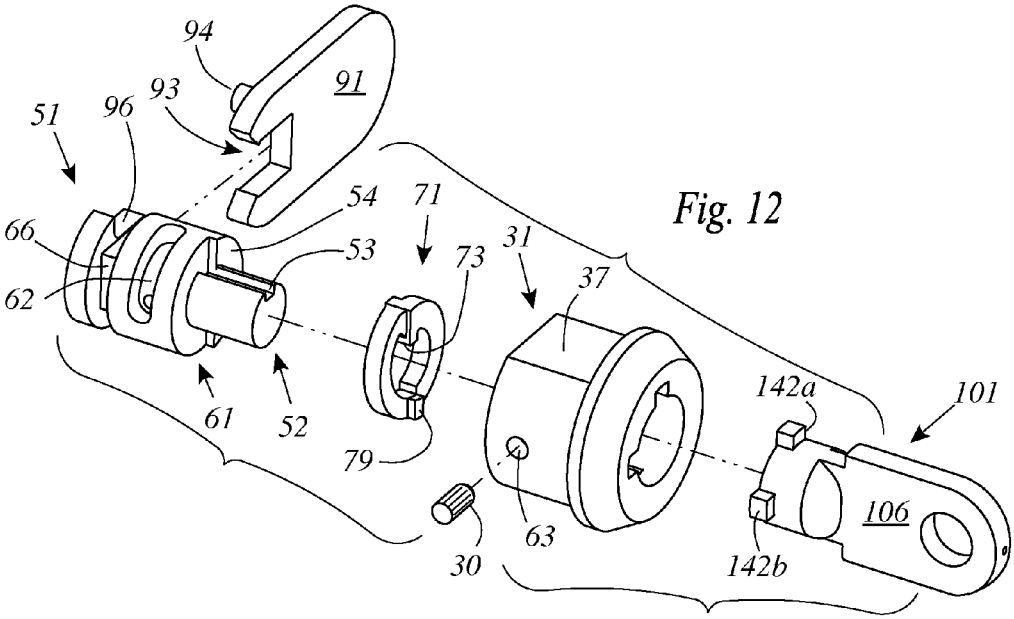
FIG. 12 is an exploded view of the components of the lock and key of the present invention.
Figure 13:
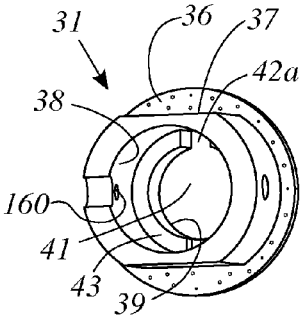
FIGS. 13-16 are perspective, side, end, and reverse side views of the lock body of the invention.
Figure 14:
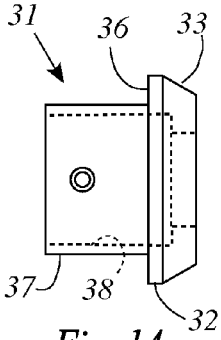
Figure 15:
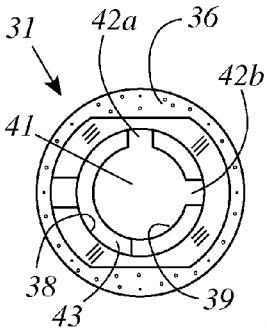
Figure 16:
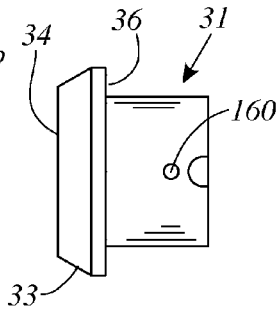
Figure 18:
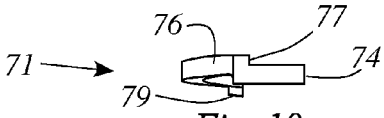
FIGS. 17-22 are perspective, side, rotated side end rotated side, and reverse end views of the lock washer of the invention.
Figure 17:
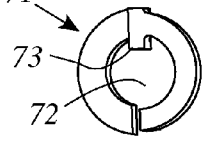
Figure 19:
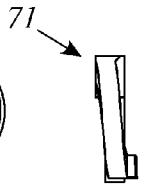
Figure 20:
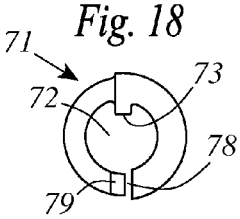
Figure 21:
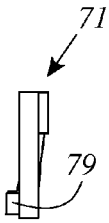
Figure 22:
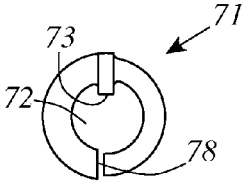
Figure 23:
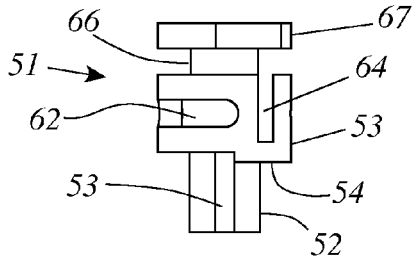
FIGS. 23-28 are front, side, end, rotated side, reverse end, and reverse front views of the spindle of the present invention.
Figure 24:
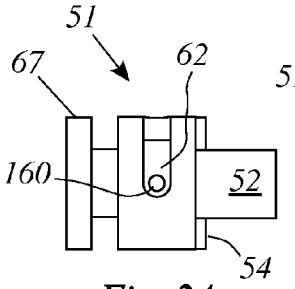
Figure 25:
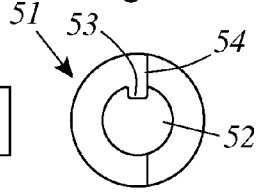
Figure 26:
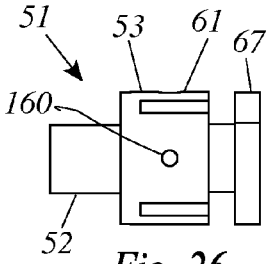
Figure 27:
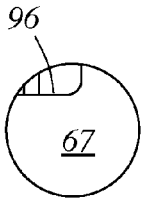
Figure 28:
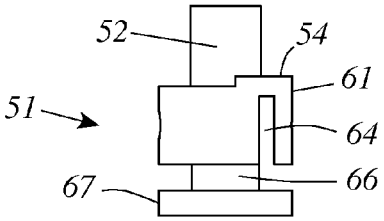

The present invention generally comprises a cam lock having an improved design that may be executed in plastic or polymer and that has a minimum component count. With regard to FIG. 12, the four components of the lock assembly include a generally cylindrical lock body 31, a spindle 51 adapted to be secured in rotatable fashion within the lock body 31 by a lock pin 30, a semi-helix split washer locking device 71 secured about the spindle 31 within the lock body, and a lock cam 91 that extends from the spindle to rotatably and releasably engage a fixed frame component or latch strike. A key 101 is also provided to enable an individual to operate the lock, as will be explained below.

With regard to FIGS. 13-16, the lock body 31 comprises a generally cylindrical tubular structure extending longitudinally along an axis and having a flange 32 extending radially from the distal end thereof. A beveled annular surface 33 extends from the flange 32 to the distal end surface 34 of the lock body. The flange 32 has a proximal-facing flat annular surface 36 that impinges on the outer surface of a door 103 (see FIG. 1) and is arranged to be glued or solvent bonded to the door outer surface adjacent to the mounting hole 104, as shown in FIG. 2. That is, a Micro Dot® treatment or the like may be applied to the surface 36 to optimize an adhesive layer or solvent coating that joins the surface 36 to a mounting surface surrounding the hole 104.

An added adaptive feature is that the exterior of the lock body 31 includes opposed flats 37 extending in parallel and chordal fashion to adapt the lock for use in a standard "Double D" hole mounting. However, it is easier to drill a circular hole, and the installation description herein shall make reference to a circular mounting hole.

A bore 38 extends axially through the lock body 31, and includes an interior shoulder 39 disposed at the distal end of the bore. The shoulder 39 extends radially inwardly to define a reduced diameter distal opening 41. A pair of key channels 42*a* and 42*b* extend through the shoulder 39 parallel to the axis of the bore, and are spaced apart 90° about the axis. In a typical installation the channels are oriented at the 9 o'clock (42*b*) and 12 o'clock positions (42*a*), as shown in FIGS. 1, 2, 5, 6, and 12, but this depiction is for clarity and uniformity only and the lock may be mounted at any useful angle. Note that the interior annular surface 43 of the shoulder 39 is stepped axially, with the surface 43 bounded at one end by one side of the channel 42*a*, and subtends an angle slightly less than 180° about the axis of the bore.

Returning to FIG. 12, the spindle 51 includes a distal portion 52 that is dimensioned to extend into the opening 41 of lock body 31, and a proximal portion 61 extending coaxially therewith and having a larger diameter configured to be received within the bore 38 in freely rotating fashion. With further regard to FIGS. 23-28, the distal portion 52 includes a keyway channel 53 extending longitudinally therein parallel to the axis of the spindle. The annular shoulder that extends between the proximal 61 and distal 52 portions of the spindle 51 has a stepped annular surface 54, similar and complementary to the stepped annular shoulder 43 in the interior of the bore 38. When the components 51 and 31 are assembled the stepped annular shoulders 43 and 54 are parallel and axially spaced apart within the lock body.

A pin channel 62 extends into the outer surface of the proximal spindle portion 61 and describes 90° of a circumferential arc about the portion 61. The lock pin 30 may be pressed into or otherwise fixed in hole 63 in the sidewall of the lock body to extend into the pin channel 62, thereby holding the lock assembly together. The lock pin 30 may be removed from hole 63 only when the lock is in the unlocked disposition. The lock pin 30 may be provided with a plurality of shallow ridges extending longitudinally and spaced at equal angles thereabout. The ridges define a virtual diameter that is slightly greater than hole 63 to provide a tight fit in hole 63 that does not expand and fracture the plastic material of the lock body 31. The placement of pin 30 retains the spindle within the lock body 31 as well as limiting the rotation of the spindle to the 90° subtended angle of the pin channel 62. In addition, a slot 64 extends chordally through the proximal portion 61 and longitudinally to a limit adjacent to the stepped annular shoulder 54. This slot is provided to remove unnecessary mass from the cast part. A neck portion 66 extends axially from the proximal end of the spindle portion 61 and is configured to extend proximally out of the proximal end of the bore of the lock body when the components are assembled. The neck portion is provided with a circumferential surface that is rectilinear and snap-engageable. A disc-like end plate 67 is joined to the proximal end of the neck 66, the plate having a diameter similar to the spindle portion 61.

Figure 3:
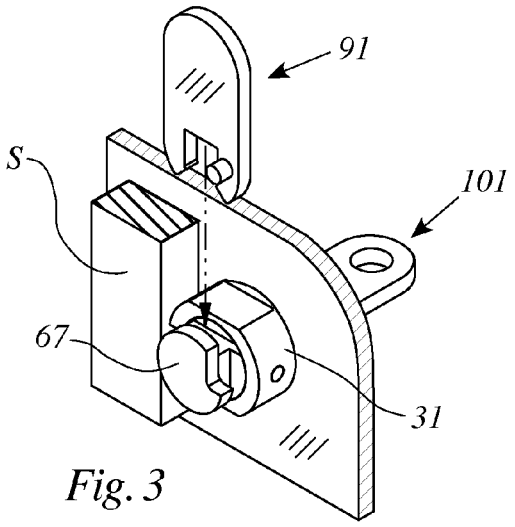
FIGS. 3 and 4 are sequential rear perspective views showing the installation of the lock cam on the lock of FIGS. 1 and 2.
Figure 4:
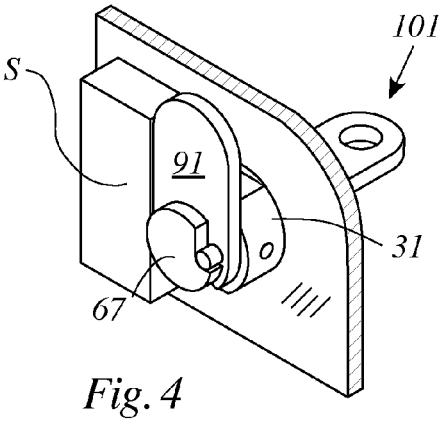
Figure 5:
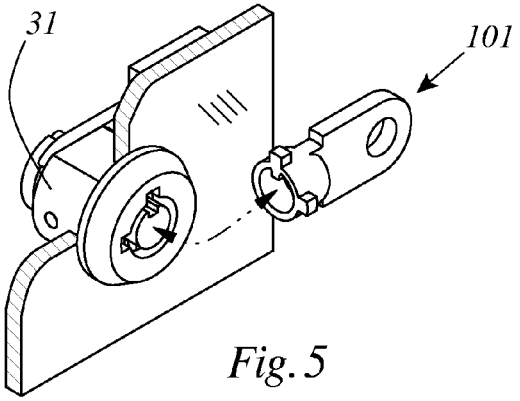
FIGS. 5 and 6 are sequential front perspective views showing the lock key being inserted and turned to release the locked door.
Figure 6:
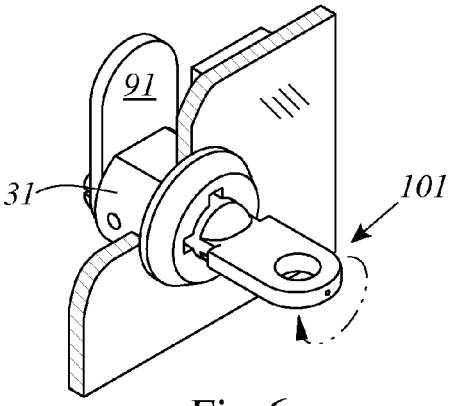
Figure 30:
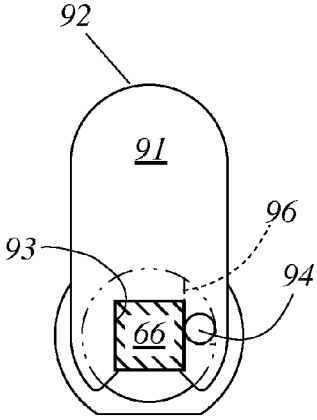
FIG. 30 is an end view showing the lock cam joined to the proximal end of the spindle of the lock.

The lock cam 91 comprises a plate-like component that is generally rectangular and is provided with a protruding end having a fully radiused perimeter 92. At the opposite end of the lock cam, a rectangular slot 93 extends into the plate, and is configured to snap-engage the neck 66 of the spindle 31, as shown for example in FIG. 30. Note that a cam pin 94 extends proximally from the lock cam 91 and is disposed adjacent to the slot 93. The end plate 67 is provided with a cutout 96 extending into the periphery thereof, the cutout having a radiused internal vertex that engages the cam pin 94 to aid in driving the cam pin to rotate into and out of engagement with a latch strike or frame component. The cutout 96 is oriented so that the lock cam 91 may be snap-engaged onto the neck 66 as the cam pin 94 slides along the cutout 96 and the radiused inner end thereof engages the cam pin as the snap-engagement is completed (see FIGS. 3 and 4).

The semi-helix split washer locking device 71, shown in FIGS. 18-22, has a central opening 72 dimensioned to receive the distal portion 52 of the spindle 51. A lug 73 extends radially into the opening 72 and is configured to be engaged in the keyway channel 53 of the spindle when the components are assembled. This engagement ensures that the semi-helix split washer locking device 71 rotates in concert with the spindle 51. One annular portion 74 of the washer semi-helix split washer locking device 71 extends semi-cylindrically about the axis from the lug 73 to the split opening of the washer. The other annular portion 76 has a ramped configuration that describes about one-half cycle of a shallow helix, extending from a step junction 77 at the lug 73 to the split opening 78, with a lug 79 disposed adjacent to the split 78 and extending distally. The annular portion 76 functions as a semi-annular leaf spring.

Figure 31:
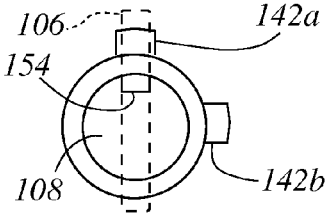
FIG. 31 is an end view of the key to the lock of the present invention.

The key 101 shown in FIGS. 1-12 includes a tabular distal end 106 and a tubular, cylindrical proximal end 107. With additional regard to FIG. 31, the interior bore 108 of the proximal end is dimensioned to slidably engage the distal end portion 52 of the spindle 51 in concentric, coaxial relationship. The outer diameter of the proximal end 107 is dimensioned to be received within the opening 41 of the lock body 31, so that the key may be inserted in an intermediate concentric position between the spindle end 52 and the inner surface of opening 41. In addition, the key is provided with a pair of outer key lugs 142*a* and 142*b* extend radially outwardly from the tubular key body and angularly spaced 90° about the axis of the tubular key body. A third key lug 154 extends radially inwardly into the bore 108. The key lugs 142*a* and 142*b* are angularly spaced apart 90°, as are the key channels 42*a* and 42*b*. Indeed, the lugs 142*a* and 142*b* are configured and positioned to slidably extend through the key channels 42*a* and 42*b*, respectively, when the key 101 is inserted in the lock. In addition, the inner key lug 154 is configured to slidably engage the keyway channel 53 in the spindle end 52 when the key is inserted in the lock. Note that the tabular handle 106 is disposed in a plane that coincides with key lugs 142*a* and 154, though this alignment is not required.

Figure 9:
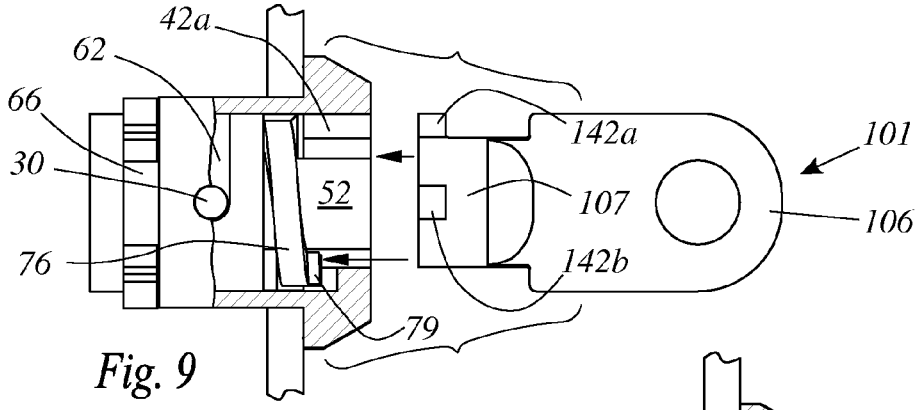
FIGS. 9 and 10 are cross-sectional side views showing the key being inserted into the lock and the flexure of the lock washer.
Figure 10:
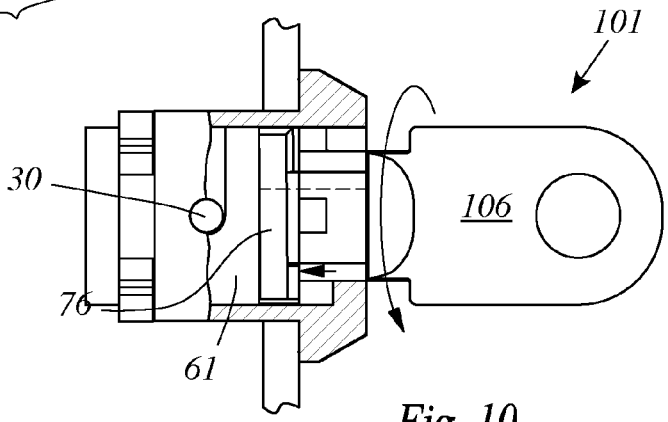
Figure 11:
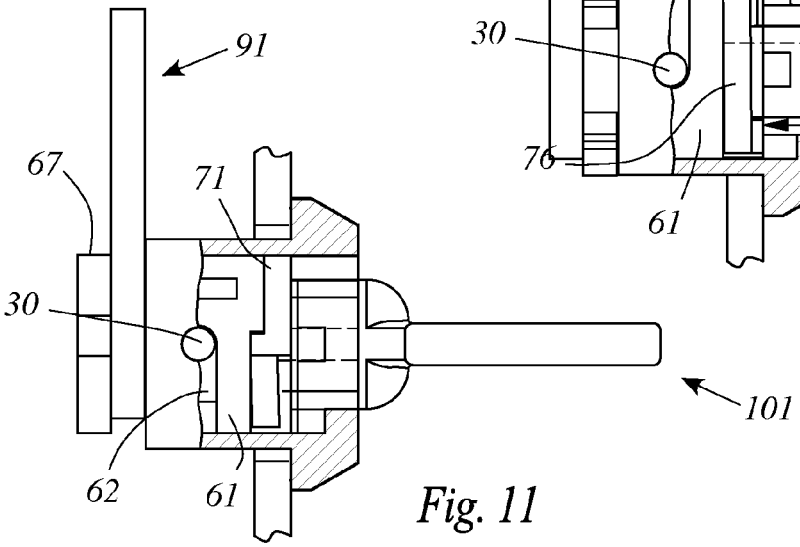
FIG. 11 is a top cross-sectional view showing the key inserted in the lock.

The lock is assembled by first securing the semi-helix split washer locking device 71 about the distal spindle portion 52, with the lug 73 engaging the keyway channel 53. In this orientation the annular step 77 of the semi-helix split washer locking device 71 engages the annular step 54 in edge-to-edge complementary engagement. Thus the semi-helix split washer locking device 71 engages the spindle across a broad area, thereby distributing torque from the key to a large portion of the spindle and avoiding localized wear and stress points. With reference to FIGS. 9-11, the lug 79 of the distal free end of the helical ramped portion 76 of semi-helix split washer locking device 71 is the distal-most part of the semi-helix split washer locking device 71. After the pin 30 is press-fit into the hole 63 and extends into the pin channel 62, the spindle is secured in the lock body 31 and limited to 90° rotation.

Figure 7:
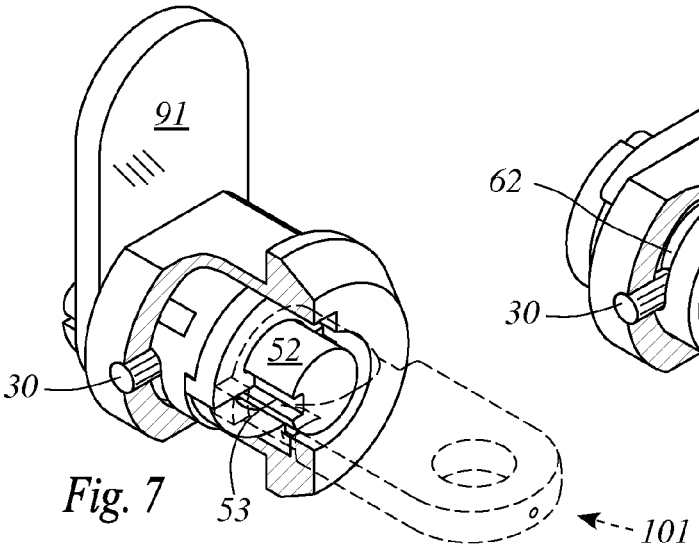
FIGS. 7 and 8 are sequential front perspective views that are partially cut away to show the functions of the spindle and key as the key is turned from open to locked disposition.
Figure 8:
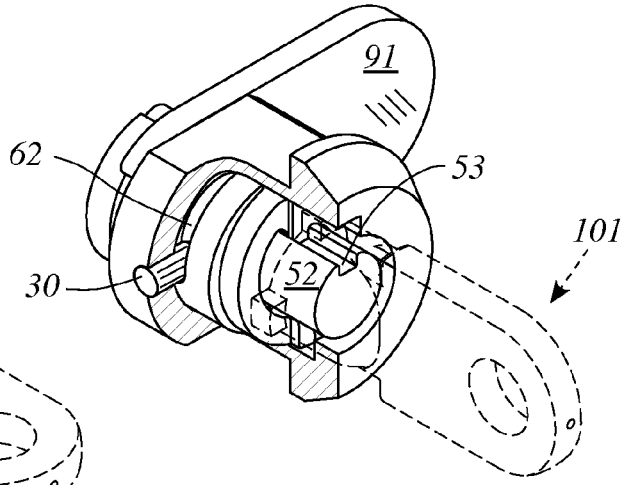

When the key 101 is inserted axially into the lock, the cylindrical proximal end 107 is slidably introduced between the spindle end 52 and the opening 41, with the key lugs 142*a* and 142*b* passing into the key channels 42*a* and 42*b*, respectively, and inner lug 154 translating in spindle keyway channel 53. The proximal edge of the key impinges on lug 79 (FIG. 9), deflecting it proximally (FIG. 10) and enabling the lug 79 to clear the stepped inner annular surface 43 of the lock body. At this point the key lugs 142 are inserted sufficiently to clear the key channels and the key is free to turn within the lock body. The user then rotates the key clockwise (as seen in FIG. 7) until the pin channel 62 impinges on pin 30 and stops rotation (FIG. 8) after a 90° excursion. The key rotation causes the spindle and semi-helix split washer locking device to rotate in unison, moving the lock cam 91 through the same angle to a lock position in which the lock cam 91 engages a latch strike or a fixed frame component S (FIGS. 1, 3, 4, 29) adjacent to the door 103. Reverse rotation of the key reverses the process. Note that the key may be removed from the lock only when the moving assembly (spindle and semi-helix split washer locking device and lock cam) are in the unlocked disposition.

Figure 1:
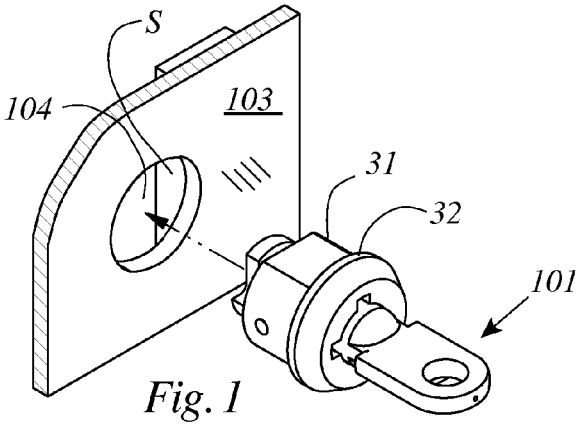
FIGS. 1 and 2 are sequential front perspective views of the lock of the present invention being inserted into a mounting hole in a door, and being secured by a glue bond or solvent cement with the door.
Figure 2:
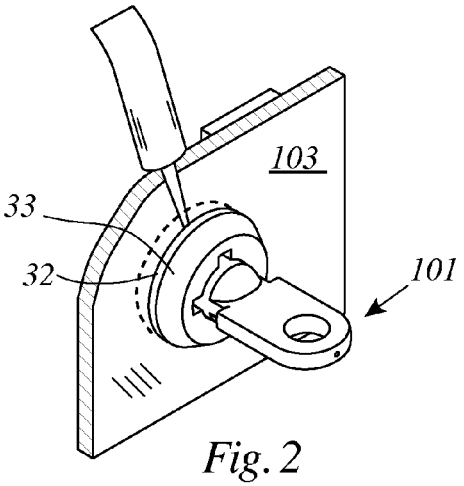

With reference to FIG. 1, to install the lock, the assembled lock without the lock cam 91 is inserted into a mounting hole 104 in a door 103. Glue or solvent adhesive is then applied to the MicroDot® surface 36 of the lock body to bond the lock to the door surface surrounding the hole 104 (FIG. 2). The lock cam 91 is then secured to the interior end of the lock (FIG. 3) by snap-engaging the slot 93 on the neck 66 of the spindle (FIG. 4), thus completing the lock installation. Thereafter a user may employ the key 101 to engage the lock and rotate the lock cam 91 from the locked disposition (FIG. 5) to the open position (FIG. 6) and vice-versa.

It should be noted that the lock described herein has a minimal parts count, and all the components are susceptible to being fabricate in molded plastic or polymer. These factors enable the lock to be produced inexpensively and sold at a competitive price. Moreover, the plastic or polymer components are very compatible with similar plastic or polymer structures, such as the door 103.

Figure 29:
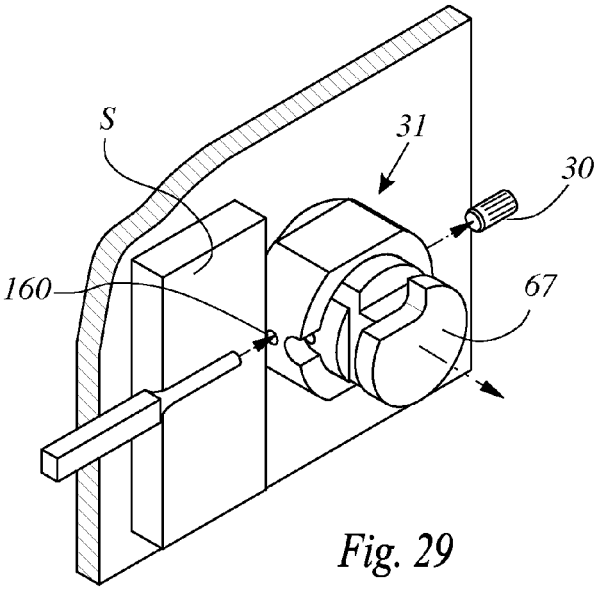
FIG. 29 is a rear perspective false view of the installed lock, showing the removal of the lock pin to release the spindle from the lock body.

As an added adaptive feature, the lock body and spindle portion 61 may be provided with aligned access holes 160 that are in diametrical alignment with pin 30 and hole 63 when the lock is rotated to the unlatched disposition. As shown in FIG. 29, this alignment enables the use of a small punch tool to be inserted through the aligned holes 160 to push the pin 30 from the hole 63 so that the spindle may be removed and lock may be disassembled. Note that this alignment occurs only when the lock is in the unlocked disposition, so that it may not be disassembled surreptitiously when locked. This feature permits the lock to be repaired when necessary, and/or for substitution of parts such as the spindle if it is desired to provide distinctive key and spindle configurations for increased security options.

Figure 32:
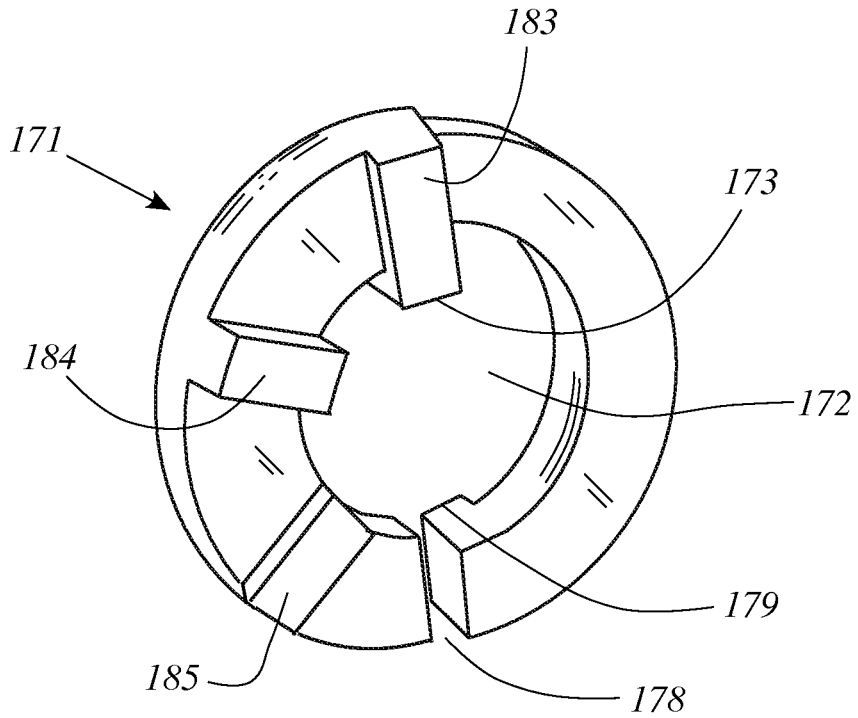
FIG. 32 is a perspective view of a further embodiment of the lock washer of the invention.
Figure 33:
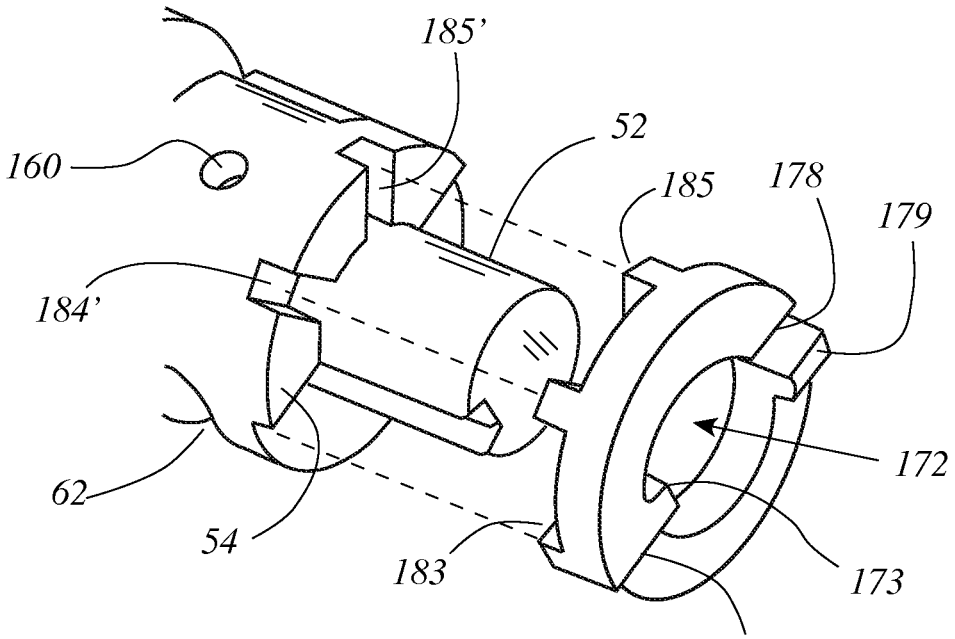
FIG. 33 is a partial exploded perspective view showing the lock washer of FIG. 32 and a complementary embodiment of the spindle of the invention.

With reference to FIGS. 32 and 33, there is depicted a further embodiment of the semi-helix split washer locking device 71, in which components of similar configuration and function are given the same reference numerals with the prefix digit one (plus one-hundred). The semi-helix split washer locking device 171 includes a central opening 172 dimensioned to receive the distal portion 52 of the spindle 51. A lug 173 extends radially into the opening 172 and is configured to be engaged in the keyway channel 53 of the spindle when the components are assembled. This engagement ensures that the semi-helix split washer locking device 171 rotates in concert with the spindle 51. One annular portion 174 of the semi-helix split washer locking device 171 extends semi-cylindrically about the axis from the lug 173 to the split opening of the washer. The other annular portion 176 has a ramped configuration that describes about one-half cycle of a shallow helix, extending from a step junction 177 at the lug 173 to the split opening 178, with a lug 179 disposed adjacent to the split 178 and extending distally. The helical annular portion 176 functions as a semi-annular leaf spring.

A further feature of the semi-helix split washer locking device 171 is added in recognition of the potential for the helical configuration of the component 171 to impart some rotational moment when it is resiliently deflected in the axial direction, and that this rotational moment may otherwise cause some misalignment of the semi-helix split washer locking device 171 and the spindle 52 with key 101 and impede rotation or removal of the key. Accordingly a trio of tabs 183, 184, and 185 are provided, projecting from the proximal face of the semi-helix split washer locking device, extending radially and arrayed at 60° equiangular spacing with respect to the central axis. A trio of complementary formed receptacles 183', 184', and 185' are provided in the annular shoulder surface 54 of the spindle to receive their respective tab in mating, easily releasable fashion. This engagement of tabs and receptacles assures that accurate angular alignment of the semi-helix split washer locking device 171 and spindle 52 is maintained. The lugs 183-185 and receptacles 183'-185' provide a rotational latching action that assures angular alignment, and that the key will rotate freely and be removable without interference. Note that the angular spacing of the tabs and receptacles shown herein is for example only, and a range of angular spacings, regular and irregular, may be employed as desired.

It is noted that the lock construction of this invention relies on only five major components, including the key. This reduced parts count is a significant advantage over the prior art, as it enables the fabrication of molded plastic components that are low cost in volume production, resulting in an inexpensive construction and a low price point. The lock is free of tumblers, and relies on the angular placement of the key lugs 142*a* and 142*b* and the internal key lug 154 for a low security lock function.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A tumbler-free cam lock for securing a moving closure with respect to a fixed frame, including:

a lock body having a bore extending along an axis therethrough, and an interior shoulder disposed at a distal end of said bore and extending radially inwardly to define a narrow distal opening;

at least one key channel extending through said interior shoulder parallel to said axis;

a central spindle extending axially in said bore in rotatable fashion, said spindle including a distal portion extending axially and distally and configured to be received within said narrow distal opening and define an annular gap therebetween;

a key having a tubular key body dimensioned to be received in said annular gap, said key including at least one outer key lug extending radially outwardly therefrom and positioned to slidably extend through said at least one key channel;

further including a semi-helix split washer locking device extending about said distal portion of said spindle and disposed coaxially within said bore and said lock body.

2. The cam lock of claim 1, further including a keyway channel extending longitudinally in said distal portion of said spindle parallel to the axis, and further including an inner key lug extending radially inwardly from said tubular key body and disposed to engage slidably in said keyway channel of said distal portion of said spindle.

3. The cam lock of claim 2, wherein said inner key lug and at least one of said outer key lugs are radially aligned with respect to the axis.

4. The cam lock of claim 1, wherein said spindle includes a proximal portion within said bore, and a pin channel formed in an exterior surface of said proximal portion of said spindle and extending in a plane perpendicular to the axis.

5. The cam lock of claim 4, further including a lock pin extending inwardly through said lock body into said pin channel to secure said spindle in said lock body.

6. The cam lock of claim 5, wherein said pin channel subtends an angle of about 90° with respect to the axis, and said lock pin limits rotation of said spindle to said subtended angle.

7. The cam lock of claim 1, wherein said spindle further includes a proximal neck portion projecting axially and proximally from said bore of said lock body, and a lock cam configured to engage said neck portion and extend radially therefrom beyond the radial extent of said lock body.

8. The cam lock of claim 7, wherein said lock cam includes snap engagement means for releasably engaging said proximal neck portion.

9. The cam lock of claim 7, further including an end plate secured to a proximal end of said spindle and defining an annular space between said end plate and said proximal portion of said spindle, said lock cam being engaged in said annular space.

10. The cam lock of claim 9, wherein said end plate includes a cutout portion extending into an edge portion thereof, and further including a cam pin extending from said lock cam parallel to the axis and disposed to be engaged in said cutout portion.

11. The cam lock of claim 1, further including an annular flange extending radially outwardly from the distal end of said lock body, said flange having a proximal annular face.

12. The cam lock of claim 1, wherein said spindle includes a keyway channel extending longitudinally in said distal portion of said spindle, and further including an inner washer lug extending radially inwardly from said semi-helix split washer locking device and disposed to engage in said keyway channel of said distal portion of said spindle.

13. The cam lock of claim 12, wherein said spindle includes a proximal portion wider than said distal portion, and an annular shoulder disposed between said proximal and distal portions of said spindle.

14. The cam lock of claim 13, wherein said semi-helix split washer locking device includes a first semi-cylindrical portion extending annularly in a plane perpendicular to the axis and disposed to impinge on said annular shoulder of said spindle.

15. The cam lock of claim 14, wherein said semi-helix split washer locking device includes a second portion extending from said first portion and describing a helical annulus defining about one-half of a helix extending about the axis and forming an annular leaf spring.

16. The cam lock of claim 15, wherein said semi-helix split washer locking device includes a plurality of tabs projecting from a proximal face thereof and spaced angularly about said axis, and a plurality of receptacles formed in said annular shoulder of said spindle, said receptacles being positioned and configured to engaged said tabs in complementary, interfitted relationship to maintain angular alignment of said spindle and said semi-helix split washer locking device.

17. The cam lock of claim 15, further including a washer lug formed at a free end of said annular leaf spring, said washer lug extending into said annular gap and positioned to be impinged upon by a proximal edge of said tubular key body when said key is inserted in said annular gap.

18. The cam lock of claim 1, further including a lock cam removably secured to said spindle and extending radially outwardly therefrom to engage an adjacent structure and secure said moving closure.

19. The cam lock of claim 18, wherein said lock body, central spindle, lock cam, and key are all formed of molded plastic material.

20. The cam lock of claim 19, further including a lock pin joining said lock body and central spindle, said cam lock being comprised exclusively of said lock body, central spindle, lock cam, lock pin, and key.

21. The cam lock of claim 1, further including a pair of said outer key lugs extending from said tubular key body at a predetermined angular separation, and a pair of said key channels extending through said interior shoulder at said predetermined angular separation to accept only keys having said outer key lugs predetermined angular separation.

* * * * *